US007993150B1

(12) United States Patent
Crow et al.

(10) Patent No.: US 7,993,150 B1
(45) Date of Patent: Aug. 9, 2011

(54) POWER DISTRIBUTION ASSEMBLY WITH GROUNDING FEATURE

(75) Inventors: Derek Crow, Wayland, MI (US); Dave Emery, Muskegon, MI (US); Steve King, Holland, MI (US); Duane Danz, Grand Rapids, MI (US); Jonathan R. DeYoung, Grand Rapids, MI (US); Jason Elzinga, Hudsonville, MI (US); Mark Wiersema, Holland, MI (US); Doug Moerler, Marne, MI (US)

(73) Assignees: Haworth, Inc., Holland, MI (US); Innotec Corporation, Zeeland, MI (US)

( * ) Notice: Subject to any disclaimer, the term of this patent is extended or adjusted under 35 U.S.C. 154(b) by 0 days.

(21) Appl. No.: 12/661,221

(22) Filed: Mar. 12, 2010

(51) Int. Cl.
*H01R 4/60* (2006.01)

(52) U.S. Cl. ..... 439/215

(58) Field of Classification Search ..... 439/207–216; 29/857

See application file for complete search history.

(56) References Cited

U.S. PATENT DOCUMENTS

| | | | | | |
|---|---|---|---|---|---|
| 4,375,010 | A | | 2/1983 | Mollenkopf | |
| 4,429,934 | A | | 2/1984 | VandenHoek et al. | |
| 4,781,609 | A | * | 11/1988 | Wilson et al. | 439/215 |
| 4,996,811 | A | | 3/1991 | Dull et al. | |
| 5,003,740 | A | | 4/1991 | Dull et al. | |
| 5,092,786 | A | * | 3/1992 | Juhlin et al. | 439/215 |
| 5,092,787 | A | * | 3/1992 | Wise et al. | 439/215 |
| 5,158,472 | A | * | 10/1992 | Juhlin | 439/215 |
| 5,186,640 | A | * | 2/1993 | McCoy | 439/211 |
| 5,214,889 | A | * | 6/1993 | Nienhuis et al. | 52/220.7 |
| 5,236,370 | A | * | 8/1993 | King et al. | 439/215 |
| 5,244,401 | A | * | 9/1993 | Russell et al. | 439/215 |
| 5,336,097 | A | | 8/1994 | Williamson, Jr. et al. | |
| 5,349,135 | A | * | 9/1994 | Mollenkopf et al. | 174/497 |
| 5,562,469 | A | * | 10/1996 | Nienhuis et al. | 439/215 |
| 5,607,317 | A | * | 3/1997 | King et al. | 439/215 |
| 5,784,841 | A | * | 7/1998 | Nowell | 52/220.5 |
| 5,785,542 | A | * | 7/1998 | Johnson | 439/213 |
| 6,455,777 | B1 | | 9/2002 | Laukhuf | |
| 6,835,081 | B2 | * | 12/2004 | Plattner et al. | 439/215 |
| 6,910,903 | B2 | * | 6/2005 | Kondas | 439/215 |
| 6,991,485 | B2 | * | 1/2006 | Plattner et al. | 439/215 |
| 7,114,972 | B1 | * | 10/2006 | Riner | 439/215 |
| 7,294,005 | B1 | * | 11/2007 | Laukhuf | 439/215 |
| 7,494,356 | B2 | * | 2/2009 | Byrne | 439/215 |
| 7,520,762 | B2 | * | 4/2009 | Lehman et al. | 439/115 |
| 7,699,631 | B2 | * | 4/2010 | Knepper | 439/215 |
| 2002/0137381 | A1 | * | 9/2002 | Chapman et al. | 439/215 |
| 2004/0102072 | A1 | * | 5/2004 | Plattner et al. | 439/215 |
| 2005/0095890 | A1 | * | 5/2005 | Plattner et al. | 439/215 |
| 2005/0130476 | A1 | * | 6/2005 | Kochanski | 439/215 |
| 2006/0024996 | A1 | * | 2/2006 | Johnson et al. | 439/215 |
| 2006/0035499 | A1 | * | 2/2006 | Johnson et al. | 439/215 |
| 2006/0052009 | A1 | * | 3/2006 | Johnson et al. | 439/660 |
| 2008/0045060 | A1 | * | 2/2008 | Knepper | 439/215 |
| 2008/0293276 | A1 | * | 11/2008 | Riner | 439/215 |
| 2009/0221169 | A1 | * | 9/2009 | Byrne | 439/211 |

(Continued)

*Primary Examiner* — Ross N Gushi

(74) *Attorney, Agent, or Firm* — Flynn, Thiel, Boutell & Tanis, P.C.

(57) ABSTRACT

A power distribution assembly (PDA) is provided with a support rail having a bendable grounding arm. This grounding arm extends from at least one axial end of the metal support rail and is bendable downwardly so as to overlie an end face of a power block on the PDA. The grounding arm includes a connector flange that projects inwardly through an access window formed in the power block, which connector flange is tight-fittingly engaged with an internal ground terminal upon insertion of the connector flange into the access window during downward bending of the grounding arm.

20 Claims, 13 Drawing Sheets

U.S. PATENT DOCUMENTS

2009/0239403 A1* 9/2009 Byrne ..... 439/215
2010/0048050 A1* 2/2010 Riner ..... 439/215
2010/0184316 A1* 7/2010 Byrne ..... 439/215
2010/0190369 A1* 7/2010 Byrne ..... 439/215

* cited by examiner

POWER DISTRIBUTION ASSEMBLY WITH GROUNDING FEATURE

FIELD OF INVENTION

The invention relates to a power distribution assembly (PDA) which forms part of a modular power distribution system for office furniture, and more particularly, to a PDA having an improved grounding feature therein.

BACKGROUND OF THE INVENTION

Modular power distribution systems are well known and comprise a plurality of modular electrical components which are connectable serially together to route power throughout an office area. These power distribution systems often include elongate power distribution assemblies (PDAs) which are mountable within raceways of conventional space-dividing wall panels, furniture or other static structures such as building raceways.

One known power distribution assembly comprises an elongate rigid mounting rail which extends substantially along the length of a wall panel and supports a pair of connector blocks or power blocks on the opposite ends thereof. The support rail houses elongate electrical conductors or wires therein which conductors define a plurality of electrical circuits and carry such circuits between said power blocks. In this regard, the conductors typically define multiple circuits of hot, neutral and ground conductors.

These conductors extend into the power blocks and have their opposite terminal ends electrically connected to individual conductor strips or terminals within the power blocks which define hot, neutral and ground terminals associated with each circuit. As such, the electrical circuits extend through the longitudinal length of the PDA wherein the power blocks include plug ports that provide access to the individual terminals and allow for plugging engagement of additional electrical system components thereto such as flex connectors, receptacles and the like.

Examples of such an electrical system are disclosed in U.S. Pat. Nos. 4,367,370 (Wilson et al.), 4,781,609 (Wilson et al.), 6,123,562 (King et al.) and 7,114,971 B1 (Johnson et al.), which are owned by the co-Assignee of the present invention, and the disclosure of which is incorporated herein by reference.

Furthermore, a commercially available electrical distribution system is sold by Haworth, Inc., the current Assignee, under the trademark Power Base. In the Power Base electrical system, the support rail of a PDA is an electrically-conductive metal rail which rigidly interconnects the PDA to one of the interior frame rails of a wall panel frame which frame rail extends along and defines one edge of a raceway.

The electrical circuits use at least one ground wire which is carried through the PDA and is grounded to the support rail. To accomplish grounding between the ground conductor and the support rail, the support rail is formed with a conductor channel which houses the conductors and a pair of foldable tabs along the intermediate length of the support rail, which tabs project downwardly into the conductor channel that is defined along the length of the support rail. The tabs are crimped or clamped about an exposed portion of an electrical conductor, and specifically, about the ground conductor. These tabs are manually crimped during assembly of the PDA to provide a suitable mechanical and electrical grounding connection between the ground conductor or wire and the support rail.

However, it is an object of the invention to provide an improved grounding connection between a support rail of a PDA and the electrical circuits carried therethrough.

The invention therefore relates to a PDA for such a modular electrical system which has an improved grounding feature which eliminates the manual crimping of tabs into engagement with the exposed conductor within the interior of the support rail channel.

The support rail is formed out of conductive metal and has a grounding arm or member formed integrally therewith in a unitary piece. Preferably, the grounding arm is initially formed as an axially extending extension of the support rail wherein the support rail has a longitudinal axis and the grounding arm essentially extends along the longitudinal axis when in an initial position. During assembly, the power block housings and interior contact terminals are assembled together in combination with the support rail which supports the power blocks thereon in downwardly depending relation. During this initial assembly, the grounding arm remains in the initial outwardly projecting position.

The housing of the power block further includes an access window which opens axially from a face of the power block and provides access to one of the contact terminals thereon, which said terminal is in the ground position and serves as a ground terminal.

More particularly, the ground terminals in the power blocks are connected to the opposite ends of an intermediate ground conductor or wire which extends between the power blocks, wherein the conductor ends and the ground terminals are internally connected together within the power block housings. The power blocks also include plug ports on the opposite side faces thereof which allow for the connection, for example, of a receptacle, which receptacle is both mechanically plugged into the power block and has its own internal conductors which electrically connect to the hot, neutral and ground terminals of the PDA.

As to the grounding arm, this grounding arm has a bendable strap, and a pair of jaw-like connector flanges, which project downwardly from the grounding arm when in the initial, outwardly-extending position. As the grounding arm is bent downwardly to an engagement position oriented at a right angle to the initial position, the grounding flanges are inserted sidewardly into the corresponding access window to engage the grounding terminal contained within the power block. The grounding flanges have a jaw-like construction with a narrow mouth defined therebetween which allows for tight fitting receipt of an edge of the grounding terminal. The power block housing also includes retainers which engage with the grounding arm during bending to retain the grounding arm in the bent, engaged position.

This grounding arm also may be formed as a separate strap having a pair of the jaw-like connector flanges which are provided at two spaced apart locations and which are separate from the support rail as well as the power blocks in the initial, disengaged position. As the grounding arm is moved to the engagement position, preferably oriented at a right angle to the support rail, one set of the grounding flanges are inserted sidewardly into the corresponding access window to engage the grounding terminal contained within the power block, and the other set of grounding flanges is fitted sidewardly onto an edge portion of the support rail. Each set of the grounding flanges has a jaw-like construction with a narrow mouth defined therebetween which allows for tight fitting receipt of the edge of the grounding terminal in the access window and the edge portion of the support rail which is preferably accessible outside of the power block. The power block housing also includes retainers which engage with the grounding arm during positioning to retain the grounding arm in the engaged position.

In this manner, the conductive support rail can be readily interconnected with an internal ground terminal merely by downward bending of the grounding arm. This improved PDA allows for improved manufacturing and a positive connection between the support rail and a ground terminal contained within a power block.

Other objects and purposes of the invention, and variations thereof, will be apparent upon reading the following specification and inspecting the accompanying drawings.

Figure 1:
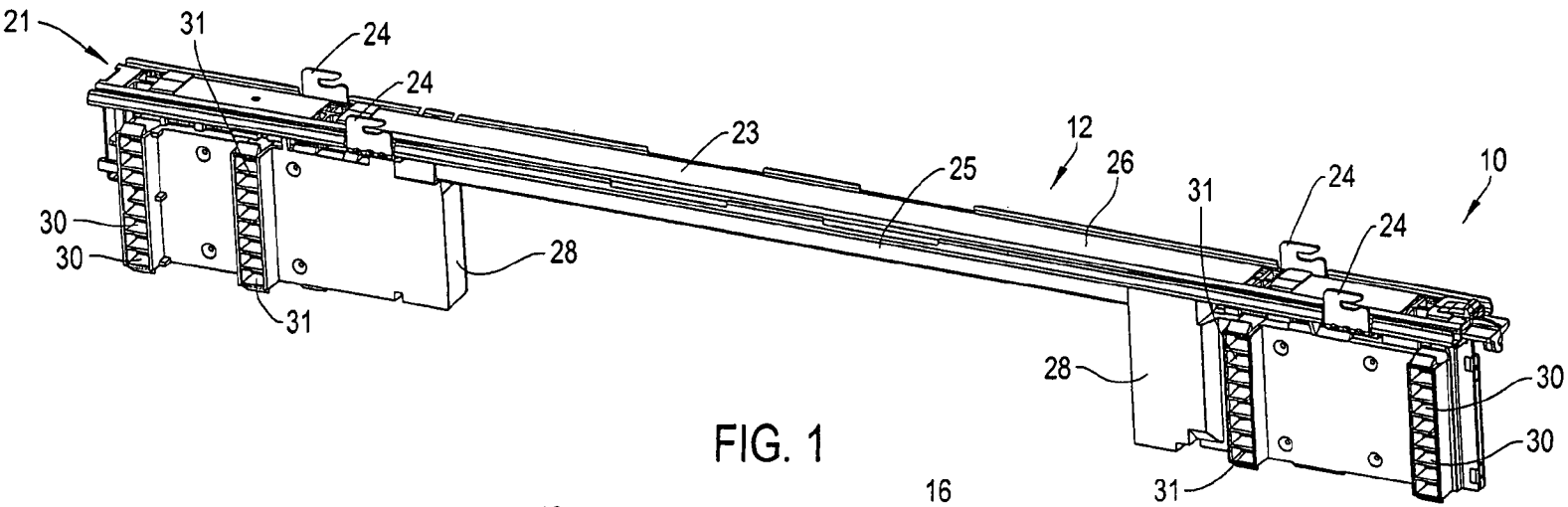
FIG. 1 is a perspective view of a power distribution assembly (PDA) according to the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
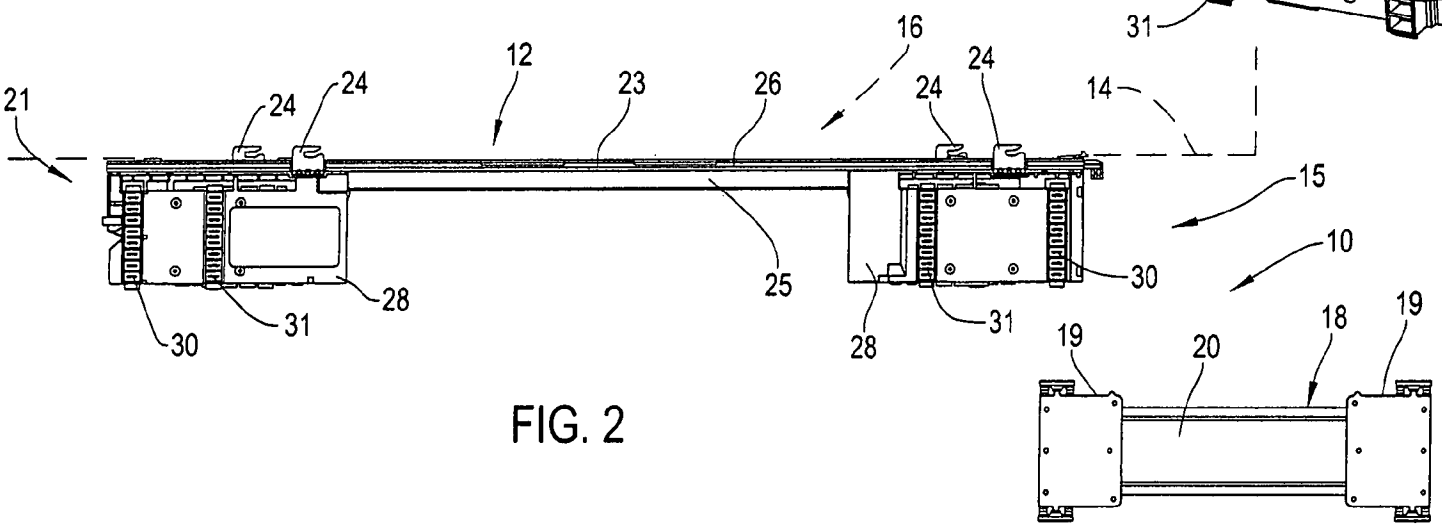
FIG. 2 is a front elevational view of the PDA in combination with a flex connector which is engageable with PDAs to join adjacent PDAs. together.

Referring to FIG. 1, the invention relates to an improvement in a power distribution system 10 which is provided to route power throughout an office area. The power distribution system 10 includes various modular system components, which system components include a power distribution assembly 12 (PDA) which is adapted to be mounted within raceways of various building structures such as space-dividing wall panels, furniture or other static structures. The PDA 12 is configured to mount to a wall panel frame rail or other similar static structure which is generally identified by reference numeral 14 (FIG. 2). The frame rail 14 or other similar structure typically defines a longitudinally extending raceway 15 in which the PDA 12 is mountable. The frame rail 14 extends along the length of a wall panel identified by reference numeral 16 wherein each PDA 12 has a length closely conforming to the length of the wall panel 16.

At the junction between adjacent wall panels 16, the power system 10 also includes a flex connector 18 which includes connector plugs 19 at the opposite ends that are adapted to plug into the ends of the PDA 12. FIG. 2 illustrates the flex connector 18 offset downwardly but aligned with the PDA 12 prior to plugging engagement therewith.

The present invention relates to an improvement in the PDA 12 and in particular, to an improved grounding feature 21 provided on the PDA 12.

The flex connector 18 also includes a conductor jacket 20 which extends between the connector plugs 19 and has a length that spans the gap between the PDAs 12 that are provided in the adjacent wall panels 16. This conductor jacket 20 is flexible so as to allow relative bending between the connector plugs 19 such as for bending around a corner between one wall panel 16 and another wall panel 16 oriented perpendicular to the first wall panel 16.

As to the construction of the PDA 12, such PDA 12 includes a conductive metal support rail 23 which extends along the length of the PDA 12, and includes a plurality of mounting hooks 24 which project upwardly and are configured to hookingly engage into the frame rail 14 of the wall panel 16. The support rail 23 includes a channel cover 25 which mounts to the main support rail body 26 to define an interior channel through which a plurality of conductor wires extend. Additionally, each PDA 12 includes a power block 28 on each opposite end which is supported in downwardly depending relation from the support rail 23. The power blocks 28 generally connect to the conductor wires and serve the function of providing access to the plurality of circuits carried by the conductor wires to permit plugging engagement of additional system components thereto.

For example, each power block 28 includes first groups of plug ports 30 which are disposed in vertical rows proximate the outermost or outboard ends of the power blocks 28. These plug ports 30 provide access to interior power block terminals which form part of the plurality of electrical circuits carried through the PDA 12. The flex connector 18 is pluggable into these plug ports 30 so that the multiple circuits are carried from the PDA 12 through the flex connector 18 to the next adjacent PDA 12 in another wall panel 16.

Additional plug ports 31 are provided in additional vertical rows inboard of the plug ports 30. These plug ports 31 allow for plugging engagement of additional system components thereto, and most typically, a plug-in receptacle which plugs into the ports 31. The receptacle includes conventional three-prong plug openings or other conventional arrangements of plug openings which are then accessible from the exterior of the wall panel 16 and allow for various components of office equipment, such as computers, to be conventionally plugged therein.

Figure 3:
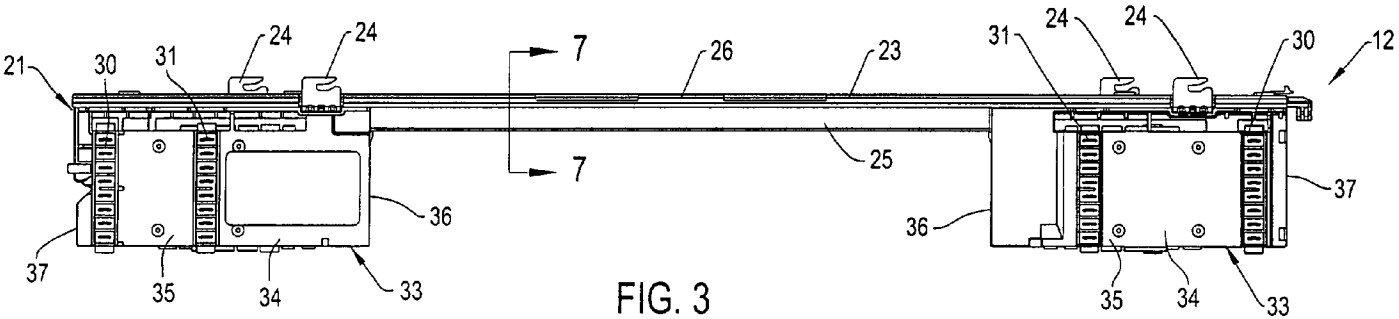
FIG. 3 is a front view of the PDA.
Figure 4:
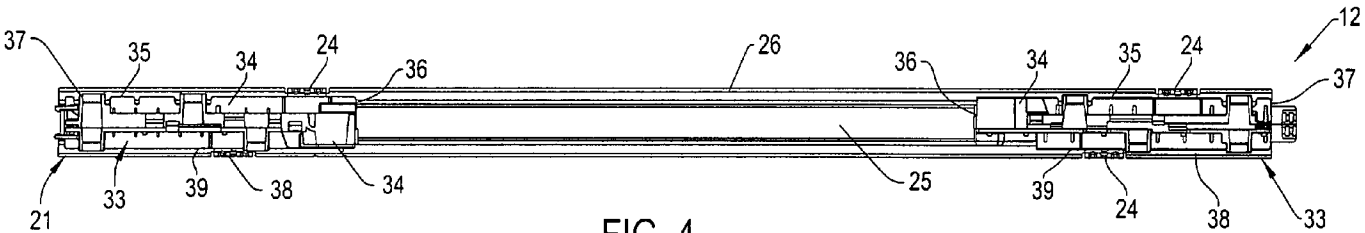
FIG. 4 is a top view of the PDA.
Figure 5:
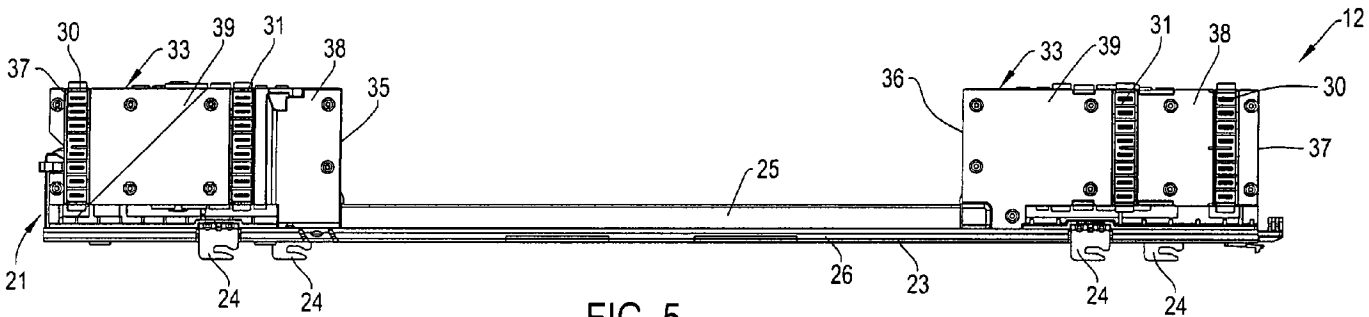
FIG. 5 is a back view of the PDA.

Referring to FIGS. 3-5, the PDA 12 is illustrated as having the support rail 23 with the mounting hooks 24 projecting upwardly therefrom in sidewardly spaced relation, while the channel cover 25 is disposed downwardly below the bottom surface of the support rail body 26. By the hooks 24, the PDA 12 may be hooked into and supported from the wall panel frame rail 14 mentioned previously.

As to the power blocks 28, these power blocks 28 are suspended downwardly from the bottom surface of the support rail 23 and include an insulative plastic outer housing 33. The housing 33 comprises a housing body 34 which defines the majority of the housing 33 so as to define one housing side face 35 as well as inboard end faces 36 and outboard end faces 37. The opposite side of the housing body 34 is enclosed by a housing cover 38 which defines the opposite side face 39. Notably, both of the opposite side faces 35 and 39 include rows of respective plug ports 30 and 31 therein.

The relative position of the vertical rows of the plug ports 30 and 31 on one power block 28 differs relative to the opposite end power block 28 as seen in FIG. 3, and also differs relative to the opposite side faces 35 and 39 as seen in FIG. 5. The relative positioning of these rows of plug ports 30 and 31 is conventional and the result of how a plug-in receptacle may be engaged to either of the opposite sides 35 or 39. Further discussion of the relative position of the plug ports 30 and 31 is not required. Generally as seen in FIGS. 3-5, the PDA 12 also includes the aforementioned grounding feature 21 on at least one of the opposite ends of the support rail 23 as will be discussed in further detail hereinafter.

Figure 6:
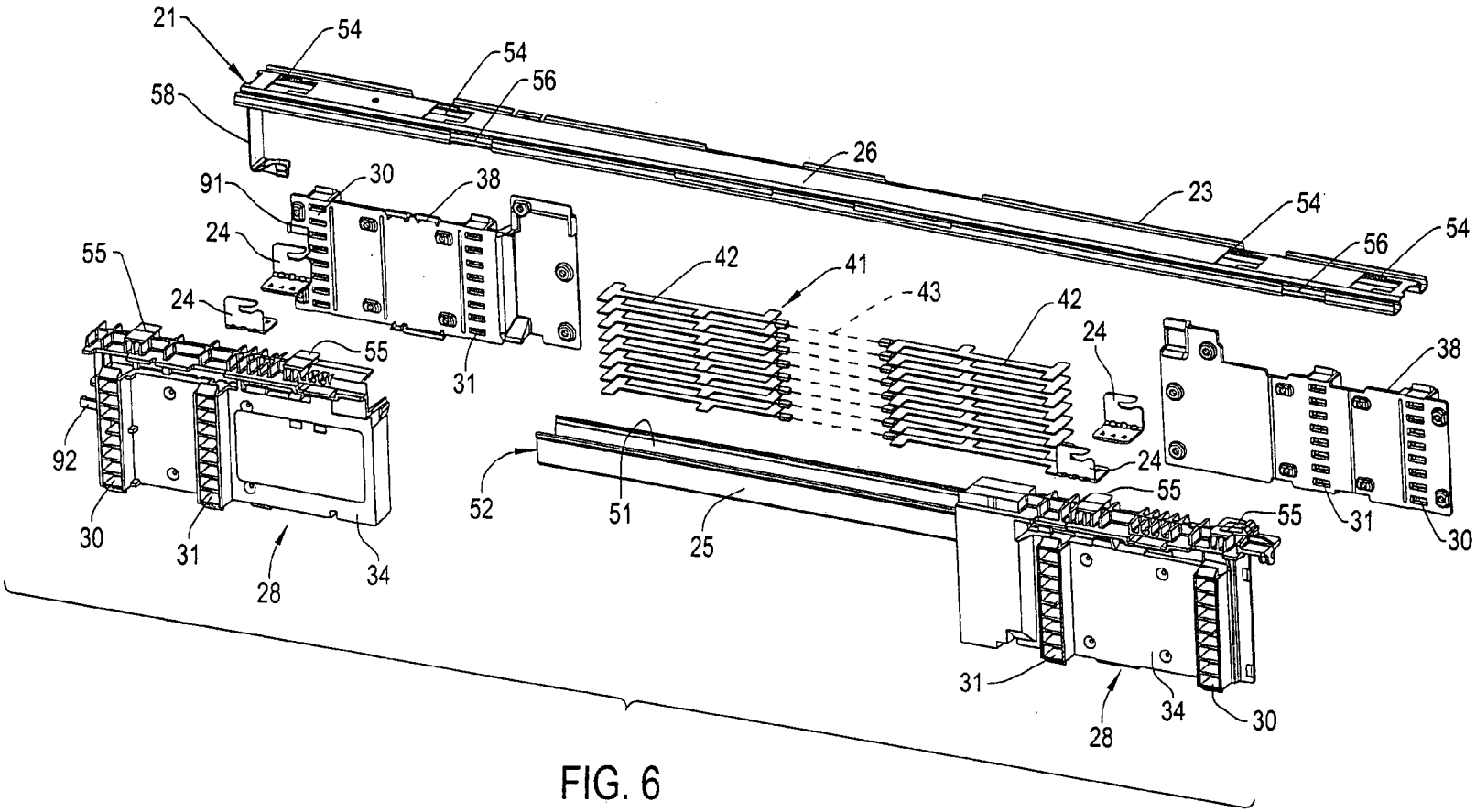
FIG. 6 is an exploded view thereof.
Figure 7:
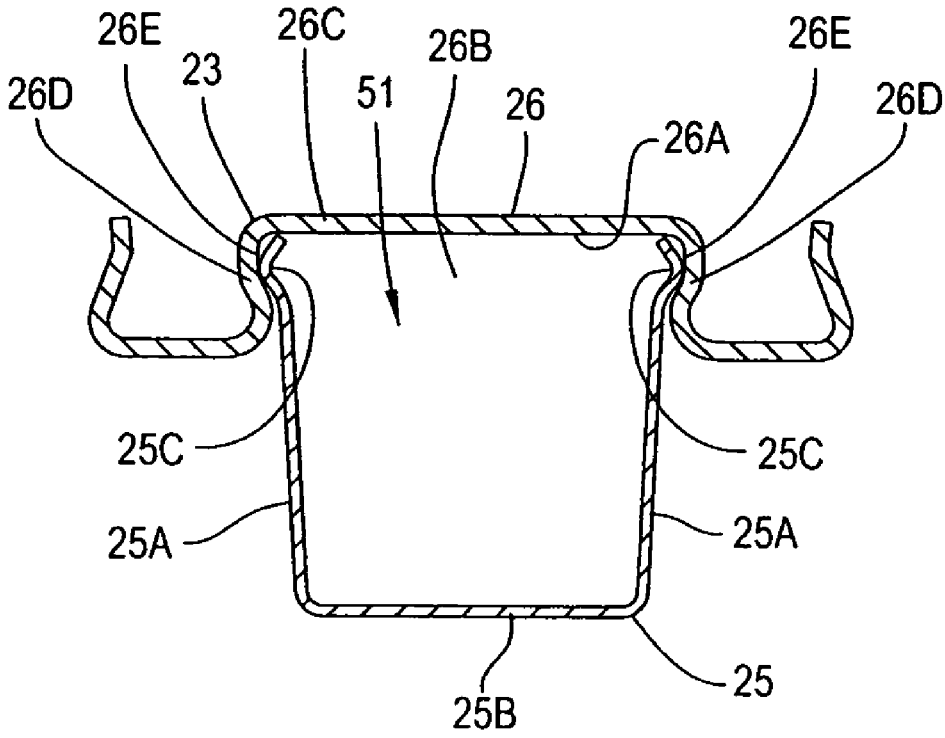
FIG. 7 is a cross-sectional view through the PDA as taken along line 7-7 of FIG. 3.
Figure 8A:
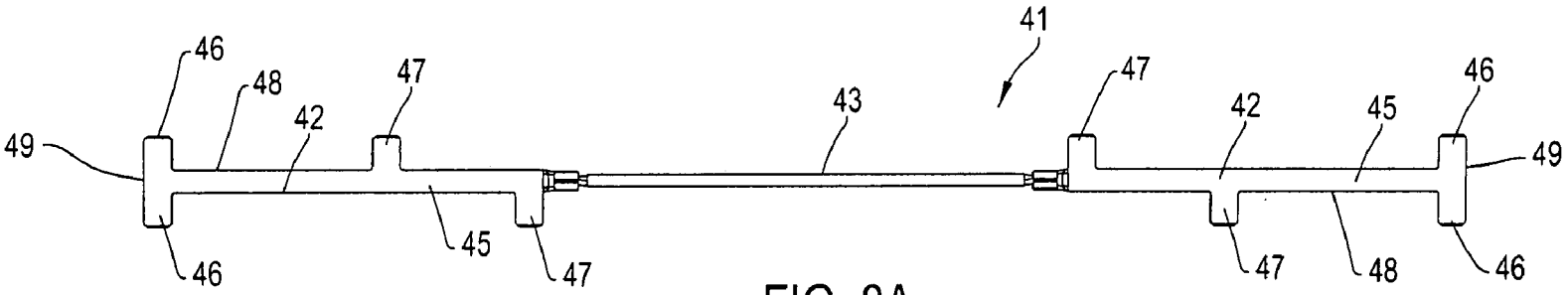
FIG. 8A is a plan view of a terminal/wire assembly.
Figure 8B:
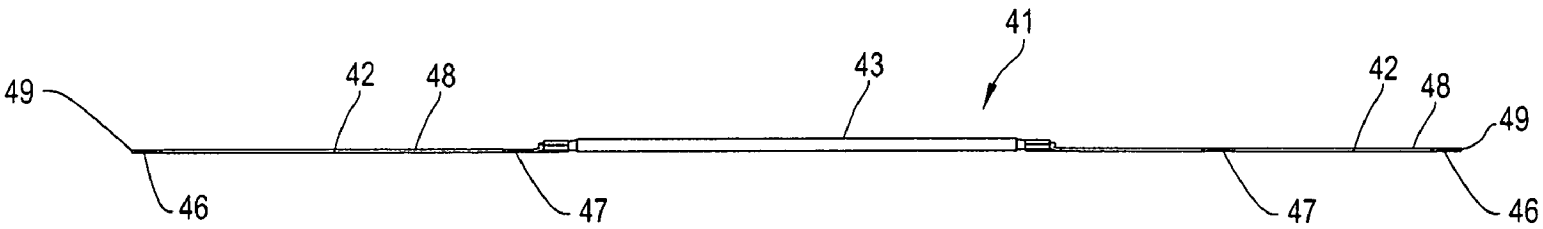
FIG. 8B is a front view of the terminal/wire assembly.

Referring to FIGS. 6-8B, the PDA 12 preferably includes a plurality of electrical circuits being carried therethrough which comprise hot, neutral and ground conductor components extending between the power blocks 28 which are then accessible through the plug ports 30 and 31. Generally, the PDA 12 includes a terminal/conductor assembly 41 which each comprise an electrical terminal 42 at the opposite ends thereof and a pre-terminated, wire-like conductor 43 which has its opposite ends electrically connected to the terminals 42. The terminal/conductor assemblies 41 are oriented in a vertical stack as seen in FIG. 6 when assembled within the PDA 12. In this regard, the terminals 42 are configured to be housed within the power blocks 28 while the elongate wire-like conductors 43 extend along the support rail 23. The terminals are collectively referenced by reference numeral 42 although one of these terminals may further be referenced as 42A to distinguish this terminal from the remaining terminals.

More particularly as to the terminals 42 (FIGS. 8A and 8B), the terminals 42 include a center web 45 which extends centrally within the power block 28, sidewardly-projecting terminal contacts 46 which are adapted to fit within the plug ports 30, as well as axially offset terminal contacts 47 which align with and are adapted to be accessible through the plug ports 31. The terminals 42 preferably are formed of a thin sheet of conductive metal such as copper and have a peripheral edge 48 extending thereabout including an end edge 49.

The terminals 42 are seated within and enclosed within the power block housing 33 wherein the conductors 43 extend longitudinally and are supported on the support rail 23. In this regard, the channel cover 25 (FIGS. 6 and 7) has an upward-opening U-shaped cross-section defined by side walls 25A and bottom wall 25B, wherein the U-shaped cross-section defines a conductor channel 51 which opens upwardly toward a bottom surface 26A of the support rail body 26. Hence, the conductor channel 51 is defined in the space between the support rail 23 and channel cover 25 wherein the conductors 43 extend longitudinally therethrough.

To secure the cover 25 to the support rail 23, the support rail body 26 has a relatively shallow, lengthwise-extending connector groove 26B defined by a center wall 26C of the support rail body 26 and groove side walls 26D that depend downwardly from the central wall 26C and curve to generally define longitudinal connector recesses 26E configured for removable engagement with the cover side walls 25A. In this regard, the cover side walls 25A have upper terminal edges which are shaped to define outwardly-protruding connector ribs 25C which mate with the connector recesses 26E. Since the channel cover 25 is resiliently deflectable, such as being formed of a plastic material, the connector ribs 25C snap fit into the connector recesses 26E to secure the cover 25 to the support rail 23.

Figure 9A:
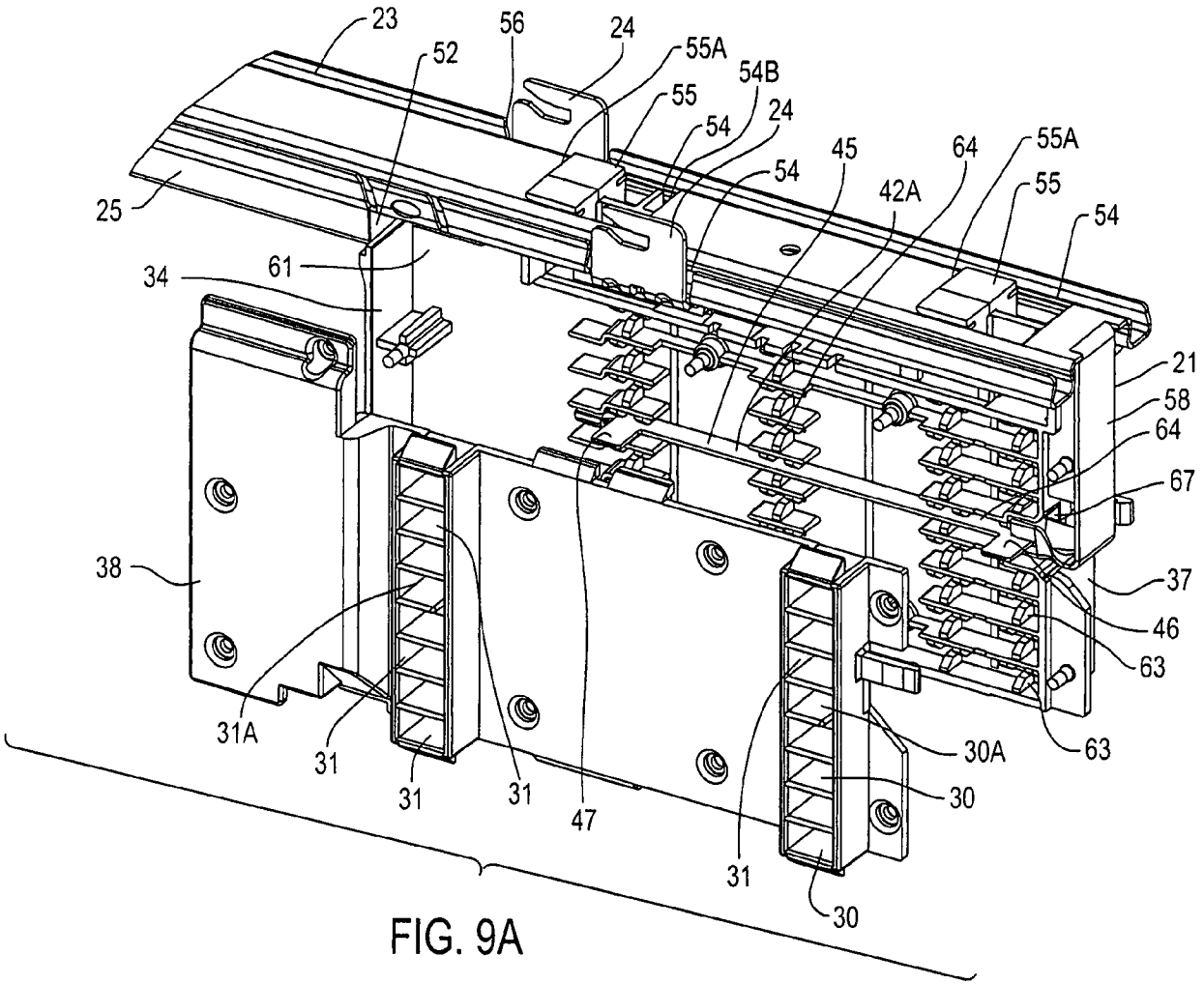
FIG. 9A is an enlarged exploded view of a power block supported on a support rail.

The opposite ends of the conductor channel 51 have channel openings 52 which open end-wise into the power block 28 as shown in FIG. 9A. This allows the conductors 43 to extend through the channel 51 with the opposite ends of the conductors 43 extending into the interior of the power blocks 28 so that the interconnected terminals 42 can seat in a vertical stack within the power block 28. This configuration is described in further detail hereinafter.

Figure 9B:
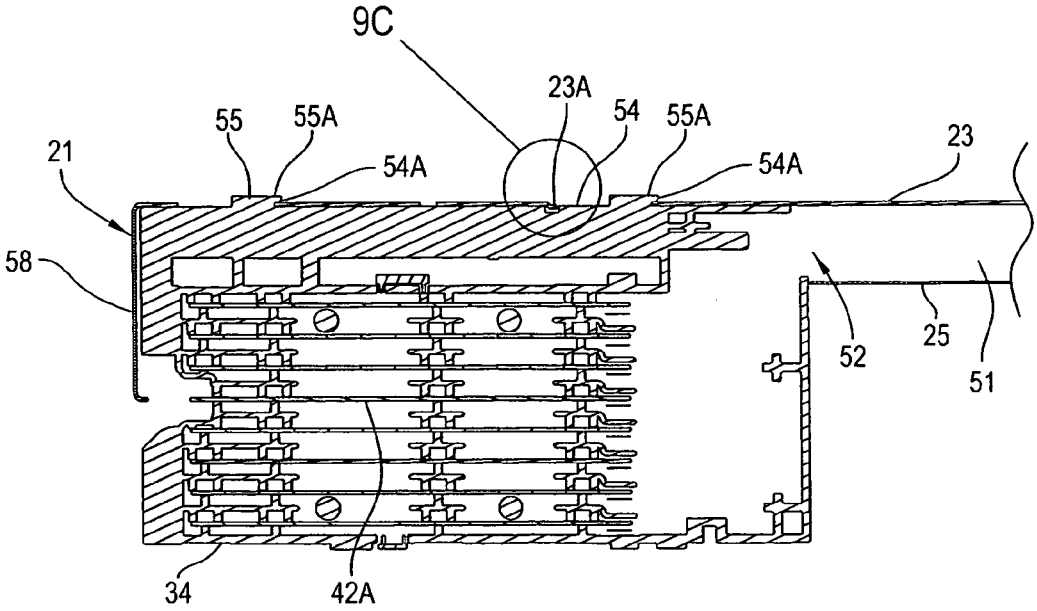
FIG. 9B is a rear elevational view in cross-section of the power block of FIG. 9A.
Figure 9C:
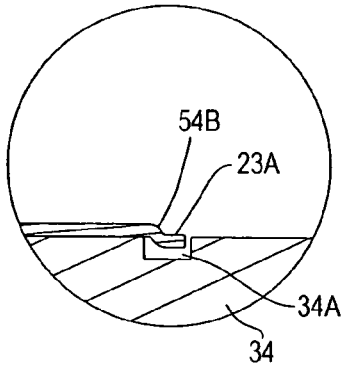
FIG. 9C is an enlarged detail of a locking

As to the vertical stack of terminals 42 shown in FIG. 6, it is understood that the plurality or group of the terminal conductor assemblies 41 defines a plurality of electrical circuits wherein each of the terminal conductor assemblies 41 serves either as a hot, neutral or ground conductor. The assignment of each conductor assembly 41 as either hot, neutral or ground can be determined depending upon the particular installation requirements and how the plurality of electrical circuits are fed from an upstream power source to a particular PDA. However, one convention has been adopted wherein the stack of eight terminal/conductor assemblies 41 defines a three-circuit configuration of three hot conductors, three neutral conductors, a common ground and an isolated ground. With respect to the terminal/conductor assembly 41 disposed in the fourth position down from the top, such terminal/conductor assembly 41 is assigned as the ground conductor as will be described in further detail hereinafter relative to FIGS. 9 and 10.

As to the remaining components of the PDA 12, the support rail 23 has mounting slots or windows 54 (FIGS. 9A-9C) which cooperate with hook-like connector mounts 55 on the housing body 34 to fixedly attach the housing body 34 on the support rail 23 in downwardly depending relation. The support rail 23 also includes pairs of slots 56 which receive the hooks 24 therethrough.

More particularly, the connector mounts 55 have a block-like shape formed from the plastic housing body 34 which mounts 55 have a sidewardly projecting lip 55A. The mounts 55 are inserted vertically through the windows 54 and then shifted sidewardly so that each respective lip 55A hooks over one edge 54A of the respective window 54. To prevent disengagement of the housing body 34 from the support rail 23, the housing body 34 is also molded with a locking slot 34A which is located so as to align with an opposite window edge 54B of one of the windows 54. The support rail 23 in turn is provided with a locking flange 23A which slides along the housing body 34 during mounting and then drops into the locking slot 34A. The slot 34A and flange 23A have opposed abutting faces which interfere with each other to normally prevent sideward shifting of the housing body 34.

With each housing body 33 mounted on the support rail 23, the terminal/conductor assemblies are then installed in the power blocks 28 with the cover 25 next installed to enclose the conductors 43. The housing cover 38 is fastened to the housing body 34 through conventional fasteners such as by heat staking of fastener pins.

Next as to the grounding feature 21 referenced above, the support rail 23 comprises this grounding feature 21 as a component thereof. In particular, the grounding feature 21 preferably comprises a grounding arm 58 which is shown in FIG. 6 as projecting downwardly and is adapted to cooperate with the ground terminal 42A shown in FIGS. 9A and 9B in the ground position. As a result, the grounding arm 58 provides a ground connection between the conductive metal support rail 23 and the respective terminal/conductor assembly 41 wherein the ground conductor 42A serves the plurality of electrical circuits carried through the PDA 12.

Figure 10:
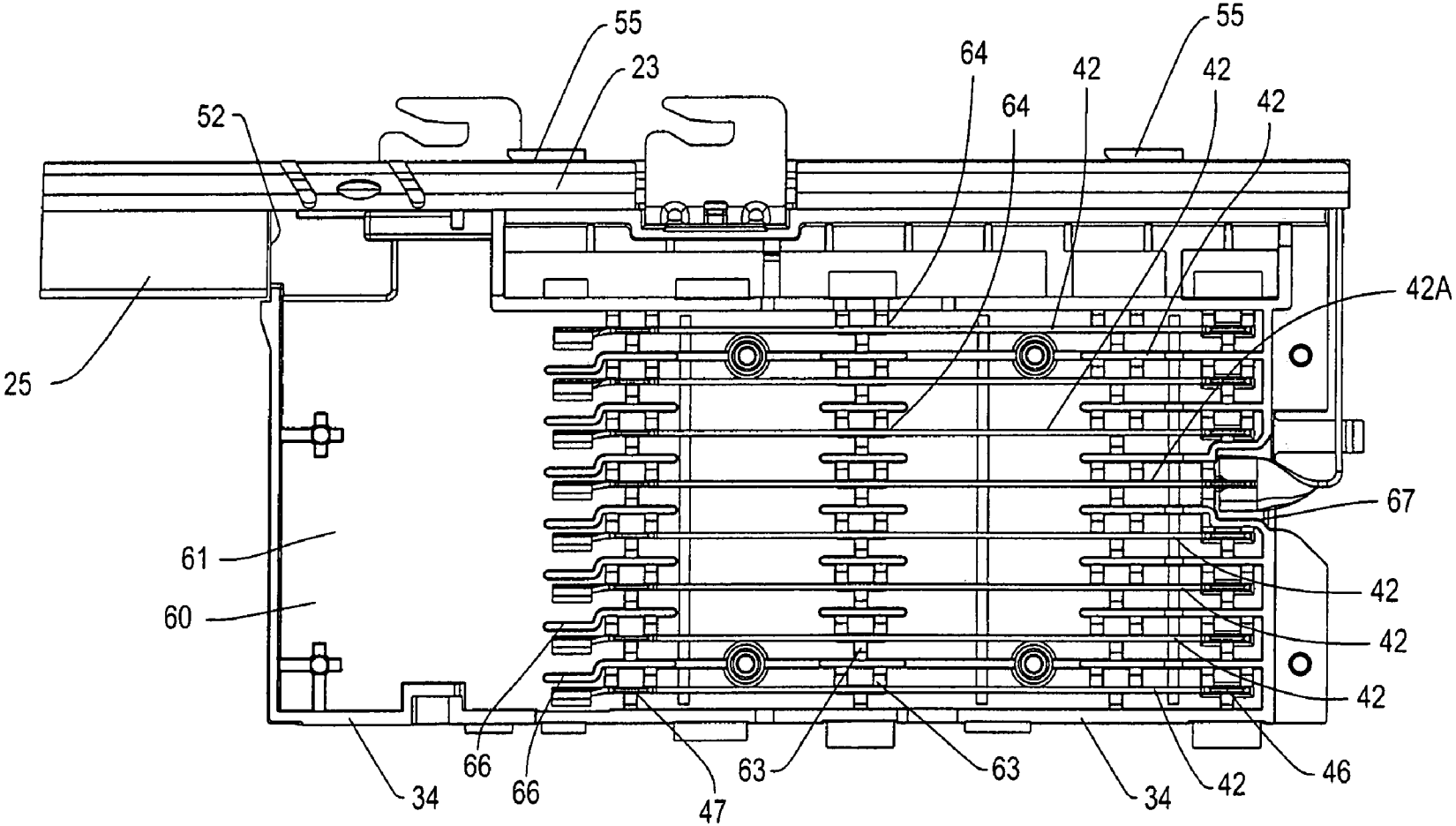
FIG. 10 is a front elevational view of the power block with the housing cover removed.

Referring to FIGS. 9A and 10, the housing body 34 defines a hollow interior chamber 60 which opens into the above-described channel opening 52 of the channel cover 25. Adjacent thereto, the inboard end of the chamber 60 is an open rectangular space 61 which allows for the conductors 43 to be flexibly bent and routed downwardly and then sidewardly from the channel opening 52 to allow for seating of the terminals 42 within the housing body 34. On the outboard end of the chamber 60, upstanding slot-forming posts 63 are provided in a row in vertically spaced relation relative to each other to define a plurality of horizontally elongate slots 64 in which the above-described electrical terminals 42 are seated. In FIG. 9, of the terminals 42, the ground terminal 42A is shown seated in a respective one of the slots 64 wherein the sideward-projecting contacts 46 and 47 of the ground terminal 42A are configured and positioned so as to be accessible through the respective ports 30A and 31A. The other contacts 46 and 47 on the other side of the terminal 42A also are aligned with and project sidewardly toward the respective plug ports 30A and 31A formed in the housing body 34.

FIG. 10 provides additional detail in that it illustrates the stack of eight terminals 42 seated in each of their respective slots 64. The endboard terminal ends 66 are disposed proximate the wiring space 61 so that the respective conductors 43 that are connected thereto (not illustrated in FIG. 10) are able to extend sidewardly and then bend upwardly so as to enter the channel opening 52.

It is noted in FIG. 10 that the various terminal contacts 46 and 47 are each arranged in a vertical row one above the other and are adapted to be accessible through the plug access ports 30 and 31 that are provided either in the housing body 34 on the one side, or the housing cover 38 on the opposite side. In this manner, the flex connector 18 could be connected to the PDA contacts 42 by plugging the flex connector 18 into the PDA plug ports 30, or alternatively, by plugging a receptacle (not illustrated) into the PDA plug ports 31 so as to electrically contact and plug into the terminal contacts 47 that are accessible therethrough.

As noted above, the PDA 12 includes an improved structure and method for connecting the support rail 23 to the ground terminal 42A of FIGS. 9A and 10 identified with the additional reference letter "A" for descriptive purposes. In this regard, the housing body 34 is formed with an access window 67 which aligns with the ground terminal 42A. The access window 67 is generally rectangular and opens through the outboard end face 37 of the housing 33.

As to the construction of the access window 67 shown in FIG. 14, the housing body 34 is formed by a first end wall portion 69 that extends vertically above and below the access window 67 and essentially defines the housing end face 37. This end wall portion 69 then turns inwardly and horizontally to define side walls 70 and 71 and then turns vertically to define a bottom wall 71 of the access window 67. The bottom wall 71 essentially closes off the access window 67 except for a narrow slot 72 which is horizontally elongate and allows for the outermost end 42B of the ground terminal 42A to project sidewardly through the bottom wall 71 and be accessible through the access window 67.

In essence, the access window 67 defines an opening to a socket 74, in which socket the terminal end portion 42B is accessible. Because of the size of the access window 67, a person handling the PDA 12 is not able to inadvertently contact the terminal section 42B with their finger due to the small size of the access window 67. However, the end edge 49 of the terminal 42A still is accessible through the window 67 for subsequent engagement with the grounding arm 58 referenced above. Engagement of the grounding arm 58 with the terminal end edge 49 is described in further detail hereinafter relative to FIGS. 11-14.

Figure 11:
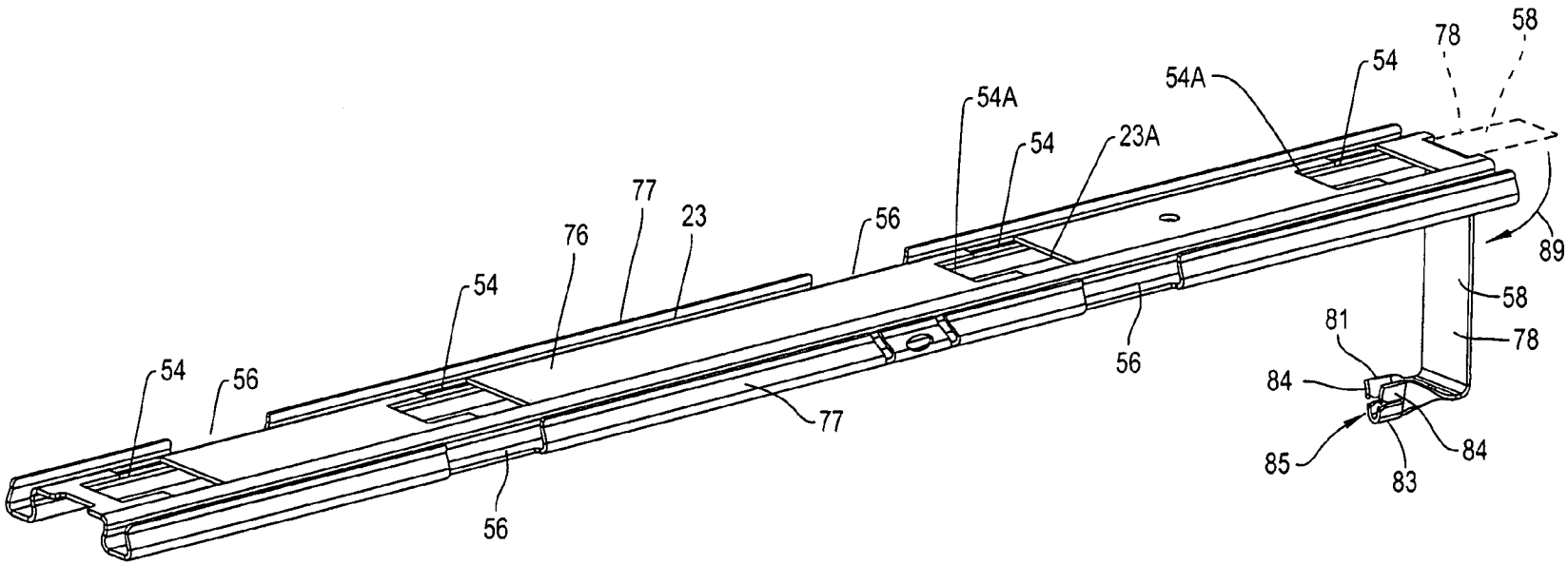
FIG. 11 is a perspective view of the support rail.
Figure 12:
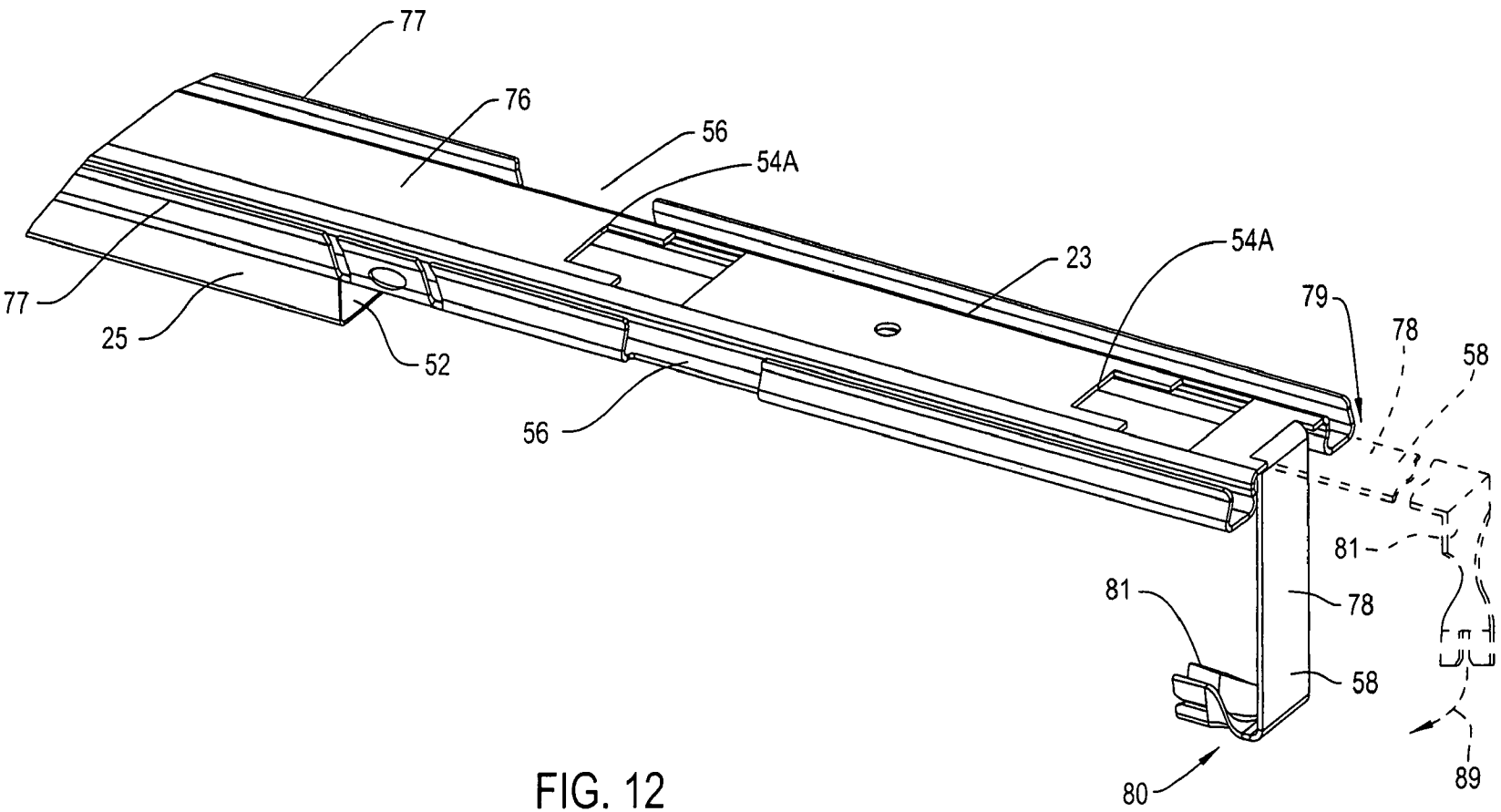
FIG. 12 is a partial perspective view of one end of the support rail with an integral grounding arm bent downwardly to an engagement position.

As to FIGS. 11 and 12, the support rail 23 has a longitudinal axis extending along the length thereof and is formed appropriately to mount the power block 28 and channel cover 25 thereto. The support rail 23 preferably includes a flat center web 76 and elongate side flanges 77 extending substantially along the length of the rail 23. As to the grounding arm 58, this arm preferably is formed as an elongate extension of the center web 76.

More particularly, the arm 58 comprises an arm body or strap 78 which preferably is integrally connected to the center web 76 so as to comprise an axial extension of the center web 76 but which can subsequently be bent downwardly. During construction of the support rail 23, the arm 58 extends axially from the end of the center web 76 in an initial position indicated in dotted outline in FIGS. 11 and 12 and designated by reference numeral 79. In this initial position 79 illustrated in phantom outline, the arm 58 projects axially from the rail end such that the strap 78 is formed co-planar with the center web 76, wherein the above-described power blocks 28 and other PDA components would then be assembled to the support rail 23. In this regard, the terminal/conductor assemblies 41 is installed within the housing body 34 and then enclosed by the cover 38. The channel cover 25 is also mounted to the support rail 23 to enclose the individual conductors 43 extending along the rail 23. Once the PDA 12 is assembled, the aforementioned terminal end edge 49 is accessible within the access window 67 as illustrated in FIG. 14. Generally, the grounding arm is engaged with the terminal end edge 49 by bending the grounding arm 58 downwardly from the initial phantom outline position 79 (FIGS. 11 and 12) to the downwardly depending engagement position 80 which is illustrated in solid outline in FIGS. 11 and 12.

To effect engagement of the grounding arm 58 with the ground terminal 42A, the grounding arm 58 preferably is formed with an engagement section 81 which projects at right angles to the strap 78 (FIG. 12). More particularly, the engagement section 81 would normally project downwardly when in the initial position 79 of FIG. 12, but then would be re-oriented sidewardly so as to project sidewardly into the access window 67 when the grounding arm 58 is bent downwardly to the engagement position 80.

Figure 13:
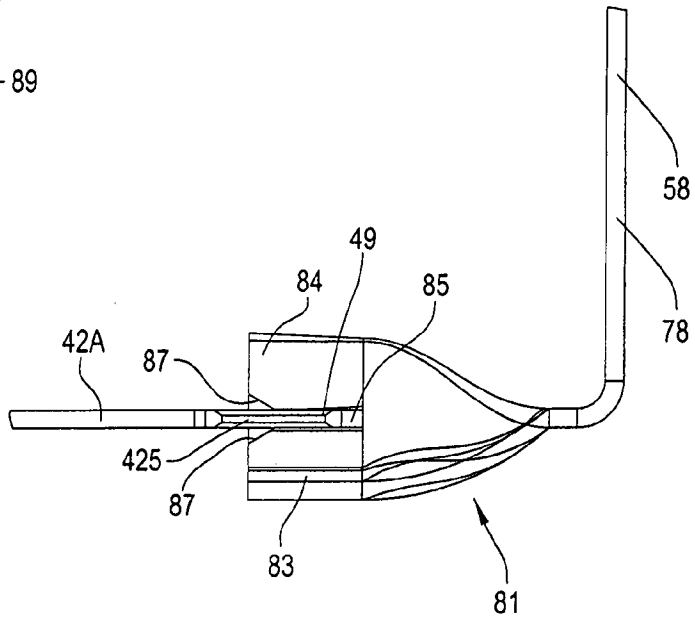
FIG. 13 is an enlarged view of a grounding flange section of the grounding arm engaged with a ground terminal.
Figure 14:
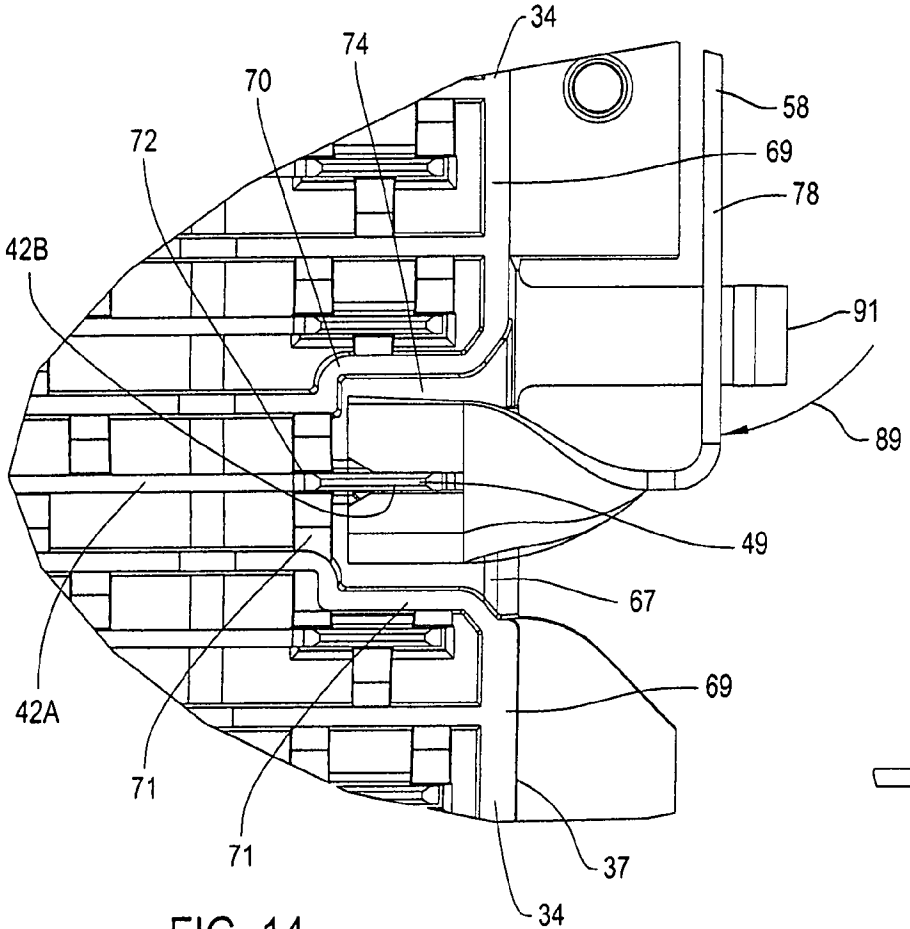
FIG. 14 illustrates the grounding flange engaged with the contact terminal within a power block housing.
Figure 16:
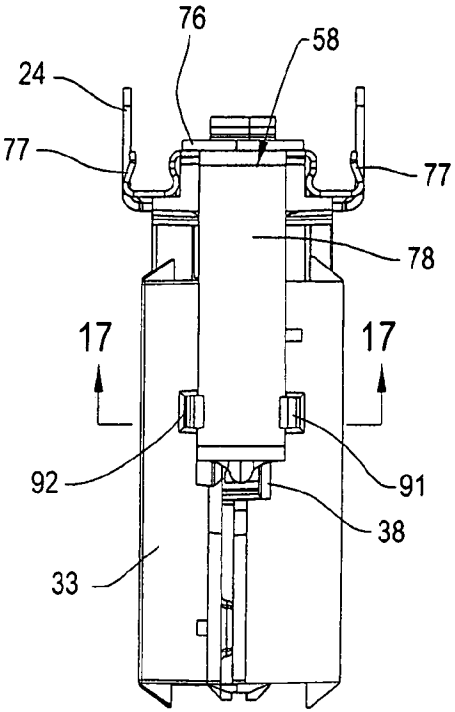
FIG. 16 is an enlarged end view of a PDA showing retainers holding said grounding member in the engaged position.
Figure 15:
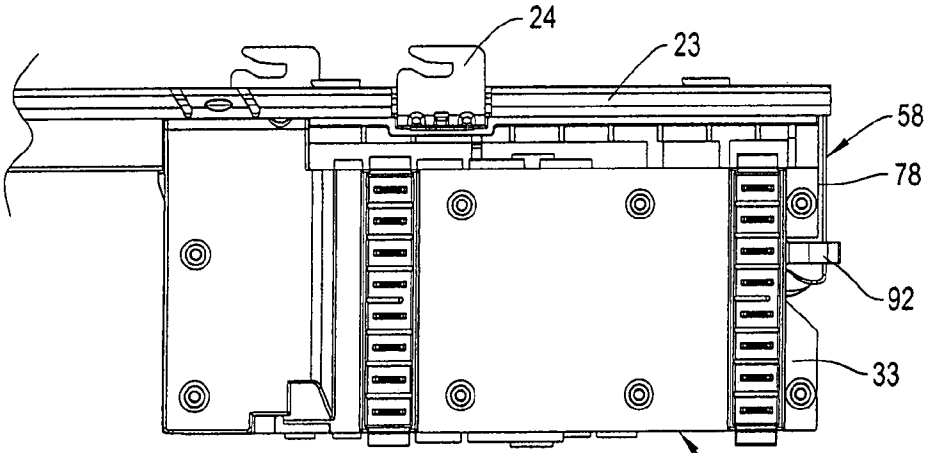
FIG. 15 is an enlarged view of the power block.
Figure 17:
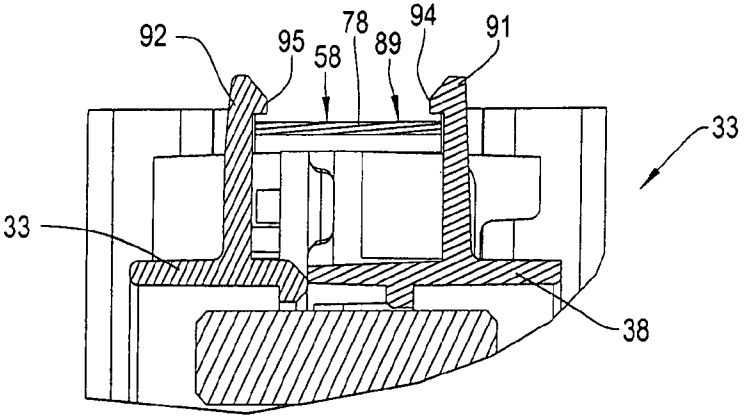
FIG. 17 is a bottom cross-sectional view of the retainers as taken along line 17-17 of FIG. 16.

The engagement section 81 (FIGS. 11-13) is formed of shaped metal material that has a U-shaped projection 83 and a pair of adjacent projections 84 wherein the projections 83 and 84 define an engagement slot or mouth 85 which is configured to tight-fittingly receive the terminal end edge 49 as seen in FIGS. 13 and 14.

The projections 83 and 84 preferably are beveled 87 at the mouth of the slot 85 to facilitate alignment of the slot 85 with the terminal end edge 49. Further, limited deflection of the projections 83 and 84 is permitted upon tight-fitting insertion of the terminal end edge 49 into the slot 85. In this manner, the terminal 42A is gripped on its opposite facing sides by the opposed jaw-like projections 83 and 84 to provide a secure mechanical and electrical connection therebetween.

Hence, during assembly, the grounding arm 58 initially is in the axially or sidewardly projecting initial position 79 of FIG. 12 and then is bent downwardly as indicated by reference arrows 89 (FIGS. 11, 12 and 14). During this re-orientation of the arm 58 from the initial position 79 to the engagement position 80, the engagement section 81 inserts into the access window 67 so that the slot 85 receives the terminal end edge 49 therein (FIG. 14). As a result, an electrical connection is effected between the conductive support rail 23 and the ground terminal 42A. While the grounding arm 58 preferably extends axially of the support rail 23, it is also possible to have the arm 58 project in other directions, such as sidewardly of the rail axis, wherein the access window 67 could then be formed in on of the power block side faces 35 or 39. Also, while it is preferred to form the arm 58 integral as one piece with the rail 23, the arm 58 and rail 23 could be formed as separate components immovably joined together by fasteners, or removably joined together as in the embodiment of FIG. 18 below.

Notably, the grounding arm 58, when in the initial position, provides clearance adjacent the rail 23 to permit mounting of the power blocks 28 and other components to the rail 23. Once assembled, the grounding arm 58 can then be bent downwardly and locked in the engagement position.

Once the grounding connection is effected, the grounding arm 58 is locked in position by additional structure on the power block 28.

Figure 18:
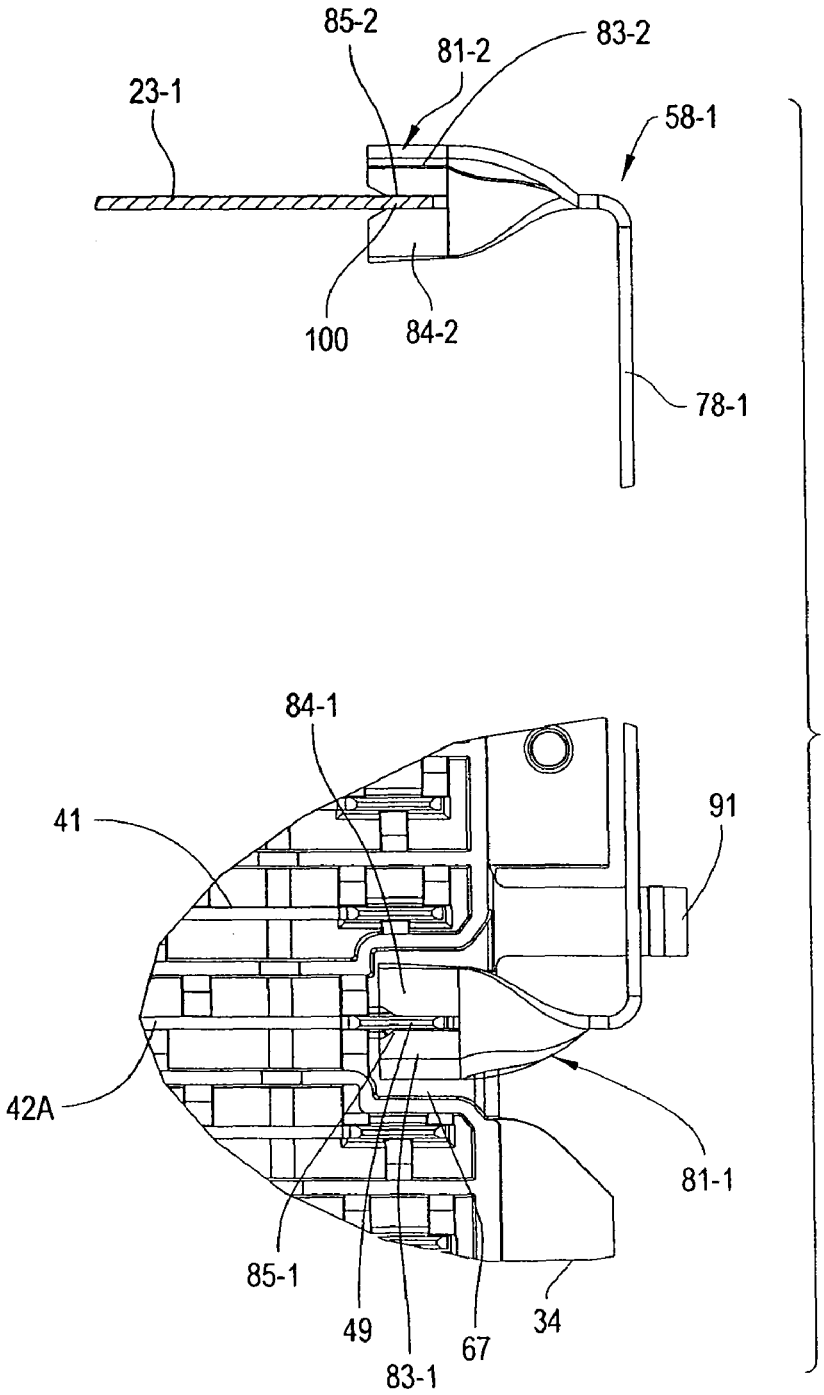
FIG. 18 is a cross-sectional view of an alternate embodiment of the invention.

Referring to FIG. 18, a further embodiment of the grounding arm is designated as 58-1 wherein the grounding arm 58-1 is formed separate from the support rail 23-1. This support rail 23-1 is formed identical to rail 23 but for the elimination of integrated, bendable arm 58 by the arm 58-1. During construction of the PDA 12, the initial position of the arm 58-1 is separate from the components, and obviously at any position remote from the PDA components 12, wherein the above-described power blocks 28 and other PDA components would then be assembled to the support rail 23-1. In this regard, the terminal/conductor assemblies 41 are installed within the housing body 34 and then enclosed by the cover 38 described above. Once the PDA 12 is assembled, the aforementioned terminal end edge 49 is accessible within the access window 67 as illustrated in FIG. 18.

To effect engagement of the grounding arm 58-1 with the ground terminal 42A, the grounding arm 58-1 preferably is formed with an engagement section 81-1 and 81-2 which are provided at the opposite ends of the strap 78-1 and project at right angles to the strap 78-1. During installation of the arm 58-1, the arm 58-1 is moved to the end of the PDA 12 wherein the engagement sections 81-1 and 81-2 project sidewardly into the access window 67 when the grounding arm 58 is moved to the engagement position shown in FIG. 18.

The engagement section 81-1 and 81-2 are formed of shaped metal material that each has a U-shaped projection 83-1 or 83-2 and a pair of adjacent projections 84-1 or 84-2 wherein the projections 83-1/83-2 and 84-1/84-2 define an engagement slot or mouth 85-1/85-2. The slot 85-1 is configured to tight-fittingly receive the terminal end edge 49 as seen in FIG. 18 and the slot 85-2 is configured to tight-fittingly receive an end edge 100 of support rail 23-1. In this manner, the terminal 42A and support rail 23-1 are gripped on opposite facing sides by the opposed jaw-like projections 83-1/83-2 and 84-1/84-2 to provide a secure mechanical and electrical connection therebetween.

Hence, during assembly, the grounding arm 58-1 initially is separated and then is mounted in place. During this mounting, the engagement section 81-1 inserts into the access window 67 so that the slot 85-1 receives the terminal end edge 49 therein (FIG. 18) while the engagement section 81-2 receives the rail end edge 100 at the same time. As a result, an electrical connection is effected between the conductive support rail 23-1 and the ground terminal 42A.

Once the grounding connection is effected, the grounding arm 58-1 is locked in position by resiliently bendable retainers 91 and 92 which snap-lockingly engage the grounding arm 58-1 along the opposite side edges of the strap 78-1. The retainers 91 and 92 are formed the same as above in at least a first pair proximate access window 67 and also a second pair may be provided upwardly therefrom nearer the support rail 23-1. The retainers 91 and 92 include inwardly extending catches as described above. These retainers 91 and 92 thereby mechanically hold or restrain the grounding arm 58-1 in the engaged position shown in FIG. 18.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A modular power distribution assembly comprising:

an electrically conductive support rail extending between opposite ends of said power distribution assembly, said support rail having opposite ends and a peripheral rail edge, wherein at least one end of said support rail includes a grounding member which is disposed outwardly of said peripheral rail edge in an initial position, said grounding member being displaceable from said initial position to an engagement position oriented transverse to the support rail, said grounding member further including a connector flange projecting sidewardly from said grounding member when in said engagement position;

at least one power block assembly disposed along the length of said support rail which comprises a housing defined by an exterior housing body that defines an interior housing chamber, a plurality of terminal ports formed through said housing wall to permit plugging engagement of an electrical component to said block assembly, a plurality of electrical terminals within said housing chamber which are accessible respectively through said access ports and which define one or more electrical circuits comprising hot, neutral and ground terminals, said housing body further including an access window disposed separate from said access ports, which said access window aligns with a terminal edge of said ground terminal;

a plurality of elongate electrical conductors having terminal ends which extend into said housing body and said interior chamber thereof and are each electrically connected to a respective one of said terminals, said conductors extending along said support rail and being supported thereby, at least a portion of said conductors being associated with said hot and neutral terminals and being electrically insulated from said support rail; and said grounding member when in said initial position being spaced from said housing body, and said grounding member, when in said engagement position, extending along at least a portion of said housing body and having said connector flange thereof projecting sidewardly through said access window into said housing body, said connector flange being in fixed contacting engagement with said grounding terminal within said interior chamber to define a grounded connection between said support rail and said ground terminal and said conductor connected thereto.

2. The power distribution assembly according to claim 1, wherein said grounding member comprises an elongate strap having one end fixedly interconnected with said support rail proximate said peripheral edge thereof, and an opposite end having said connector flange disposed thereon.

3. The power distribution assembly according to claim 2, wherein said strap is formed in cantilevered relation with said support rail and is bendable from said initial position to said engagement position.

4. The power distribution assembly according to claim 3, wherein said connector flange comprises first and second projections which define a narrow slot therebetween, said slot tight-fittingly receiving said ground terminal therein for tight-fitting engagement of said connector flange to said ground terminal which defines said grounded connection therebetween.

5. The power distribution assembly according to claim 1, wherein said support rail and said grounding member are formed in a unitary construction with said grounding member projecting sidewardly in cantilevered relation with said support rail and being bendable by deformation of a portion of said grounding member from said initial position to said engagement position.

6. The power distribution assembly according to claim 5, wherein said housing body includes retainers which engage with said grounding member when displaced to said engagement position to fixedly maintain said grounding member in said engagement position.

7. A modular power distribution system comprising a power distribution assembly and an electrical component connectable thereto, said power distribution assembly comprising:

an electrically conductive support member configured to support said power distribution assembly on a support structure, said support member having opposite ends and a peripheral edge, wherein said peripheral edge includes a grounding member which projects outwardly from said peripheral edge in an initial position, said grounding member having a fixed end fixed to said support member and a free end which is displaceable to reorient said grounding member from said initial position to an engagement position oriented transverse to the initial position, said grounding member further including an engagement section disposed on one side of said grounding member;

at least one power block assembly supported by said support member which comprises an insulative housing comprising an exterior housing body defining an interior housing chamber, a plurality of terminal ports formed through said housing wall to permit plugging engagement of an electrical component, and a plurality of conductive electrical terminals within said housing chamber which are accessible respectively through said access ports and which define one or more electrical circuits comprising hot, neutral and ground terminals, said housing being mounted to said support member with said grounding member disposed in said initial position, said housing body further including an access window disposed separate from said access ports, which said access window aligns with an exposed portion of said ground terminal; and said grounding member when in said initial position being spaced from said housing body to permit assembly of said housing to said support member, and said grounding member, when in said engagement position, extending along at least a side portion of said housing body and having said engagement section thereof projecting sidewardly through said access window into said housing body, said engagement section being in fixed contacting engagement with said grounding terminal within said interior chamber to define a grounded connection between said support member and said ground terminal.

8. The power distribution system according to claim 7, wherein said engagement section of said power distribution assembly is in a first orientation in said initial position and a second orientation transverse to said first orientation when in said engagement position.

9. The power distribution system according to claim 8, wherein said ports are formed in a first face of said housing and said access window is formed in a second face of said housing.

10. The power distribution system according to claim 7, wherein said terminals connect to a respective plurality of elongate electrical conductors having terminal ends which extend into said housing body and said interior chamber thereof and are each electrically connected to a respective one of said terminals, said conductors extending along said support member and being electrically insulated from said support member.

11. The power distribution system according to claim 7, wherein said grounding member comprises an elongate strap having said fixed end is fixedly interconnected with said support member proximate a peripheral edge thereof, and said free end having said engagement section disposed thereon.

12. The power distribution system according to claim 11, wherein said strap is formed in cantilevered relation with said support member and is bendable from said initial position to said engagement position.

13. The power distribution system according to claim 7, wherein said grounding terminal has an exposed terminal portion thereof which is accessible through said access window, said engagement section defines a seat which tight-fittingly receives said exposed terminal portion therein for tight-fitting engagement of said grounding member to said ground terminal.

14. The power distribution system according to claim 13, wherein said housing body includes retainers which lockingly engage with said grounding member when displaced to said engagement position to fixedly maintain said grounding member in said engagement position.

15. The power distribution system according to claim 7, wherein said housing body includes retainers which lockingly engage with said grounding member when displaced to said engagement position to fixedly maintain said grounding member in said engagement position.

16. A modular power distribution system comprising a power distribution assembly and an electrical component connectable thereto, said power distribution assembly comprising:

an electrically conductive support member configured to support said power distribution assembly on a support structure, said support member including a repositionable grounding member which projects outwardly from said support member in an initial position and is displaceable to reorient said grounding member from said initial position to an engagement position oriented transverse to the initial position, said grounding member further including an engagement section disposed on one side of said grounding member, said engagement section of said power distribution assembly being in a first orientation in said initial position and a second orientation transverse to said first orientation when in said engagement position;

at least one power block assembly supported by said support member which comprises an insulative housing comprising an exterior housing body defining an interior housing chamber, a plurality of terminal ports formed through said housing wall to permit plugging engagement of said electrical component, and a plurality of conductive electrical terminals within said housing chamber which are accessible respectively through said access ports and which define one or more electrical circuits comprising hot, neutral and ground terminals, said housing body further including an access window disposed separate from said access ports, which said access window aligns with an exposed terminal portion of said ground terminal; and said grounding member when in said initial position being spaced from said housing body, and when in said engagement position, being disposed exteriorly of said housing body and having said engagement section thereof projecting through said access window into said housing body, said engagement section being in grounded engagement with said grounding terminal; and said housing body including retainers which lockingly engage with said grounding member when displaced to said engagement position to fixedly maintain said grounding member in said engagement position.

17. The power distribution assembly according to claim 16, wherein said grounding member comprises an elongate strap having a fixed end fixedly interconnected with said support member proximate a peripheral edge thereof, and a free end having said engagement section disposed thereon.

18. The power distribution assembly according to claim 16, wherein said grounding member comprises an elongate strap formed in cantilevered relation with said support member, said strap being bendable from said initial position to said engagement position.

19. The power distribution assembly according to claim 18, wherein said retainers snap lockingly engage said strap.

20. The power distribution assembly according to claim 16, wherein said retainers are formed on said housing body proximate said access window.

* * * * *